US009218951B2

(12) United States Patent
Kim et al.

(10) Patent No.: US 9,218,951 B2
(45) Date of Patent: Dec. 22, 2015

(54) PLASMA LIGHTING SYSTEM WITH LIGHT SENSOR FOR CONTROL BASED ON INTENSITY

(71) Applicant: LG Electronics Inc., Seoul (KR)

(72) Inventors: Donghun Kim, Seoul (KR); Junsung Kim, Seoul (KR); Byeongju Park, Seoul (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 14/335,667

(22) Filed: Jul. 18, 2014

(65) Prior Publication Data

US 2015/0214022 A1 Jul. 30, 2015

(30) Foreign Application Priority Data

Jan. 27, 2014 (KR) ..... 10-2014-0009484

(51) Int. Cl.
*H01J 65/04* (2006.01)
*H01J 61/52* (2006.01)
*H05B 41/392* (2006.01)

(52) U.S. Cl.
CPC ..... *H01J 65/044* (2013.01); *H01J 61/523* (2013.01); *H01J 65/04* (2013.01); *H05B 41/3922* (2013.01)

(58) Field of Classification Search
CPC ..... H01J 65/044; H01J 61/523; H01J 65/04; H05B 41/3922
USPC ..... 315/248
See application file for complete search history.

(56) References Cited

U.S. PATENT DOCUMENTS 4,954,756 A 9/1990 Wood et al.
4,978,891 A 12/1990 Ury
5,404,076 A 4/1995 Dolan et al.
6,469,444 B1 10/2002 Leng et al.
6,744,221 B2 * 6/2004 Choi ..... H05B 41/24 313/231.61
6,946,795 B2 9/2005 Jeon et al.
2002/0101191 A1 8/2002 Dolan et al.
2006/0250065 A1 * 11/2006 Lee ..... H01J 65/044 313/113
2008/0315799 A1 * 12/2008 Park ..... H01J 61/106 315/344
2009/0146587 A1 * 6/2009 Li ..... H01J 61/52 315/501
2010/0156295 A1 * 6/2010 Park ..... H01J 65/044 315/39

FOREIGN PATENT DOCUMENTS

WO WO 93/21655 A1 10/1993

* cited by examiner

*Primary Examiner* — Dylan White
(74) *Attorney, Agent, or Firm* — Birch, Stewart, Kolasch & Birch, LLP

(57) ABSTRACT

A plasma lighting system includes a magnetron configured to generate microwaves, and a bulb filled with a main dose and an additive dose. The main dose and the additive dose generate light under the influence of microwaves and have the maximum intensities of respective intrinsic wavelengths at different wavelengths. A waveguide is configured to guide the microwaves generated by the magnetron to the bulb. A motor is configured to rotate the bulb. A sensor is configured to sense the intensity of light having a specific wavelength emitted from the bulb. A controller is connected to the motor. The controller adjusts the Revolutions Per Minute (RPM) of the bulb based on the intensity of light having the specific wavelength sensed by the sensor. With this arrangement, a Color Rendering Index (CRI) of the plasma lighting system may be adjusted during operation.

20 Claims, 4 Drawing Sheets

PLASMA LIGHTING SYSTEM WITH LIGHT SENSOR FOR CONTROL BASED ON INTENSITY

Pursuant to 35 U.S.C. §119(a), this application claims the benefit of Korean Patent Application No. 10-2014-0009484 filed on Jan. 27, 2014, which is hereby incorporated by reference as if fully set forth herein.

BACKGROUND OF THE INVENTION

1. Field of the Invention

The present invention relates to a plasma lighting system, and more particularly to a plasma lighting system, a Color Rendering Index (CRI) of which may be adjusted.

2. Discussion of the Related Art

In general, a lighting system using microwaves (several hundred MHz to several GHz) is designed to generate visible light by applying microwaves to an electrodeless plasma bulb.

The microwave lighting system is an electrodeless discharge lamp in which a quartz bulb having no electrode is filled with inert gas.

Recently, the microwave lighting system is configured to emit a continuous spectrum in a visible light range via high voltage electrical discharge of sulfur. The microwave lighting system is also referred to as a plasma lighting system.

Meanwhile, Color Rendering Index (CRI) is one metric of a light source, and represents a light source's ability to show object colors realistically or naturally. That is, CRI is a numerical value representing similarity between the original color of an object and the color of the object under specific lighting.

The plasma lighting system has optical properties of continuous spectra due to use of sulfur as a dose. However, when sulfur is used as a dose, a CRI of the plasma lighting system is about 80, which is lower than that of a general High Intensity Discharge (HID) lighting system.

SUMMARY OF THE INVENTION

Accordingly, the present invention is directed to a plasma lighting system that substantially obviates one or more problems due to limitations and disadvantages of the related art.

One object of the present invention is to provide a plasma lighting system, a Color Rendering Index (CRI) of which may be adjusted.

Another object of the present invention is to provide a plasma lighting system, a Color Rendering Index (CRI) of which may be adjusted during operation.

Another object of the present invention is to provide a plasma lighting system which may increase or reduce the intensity of light at a specific wavelength.

A further object of the present invention is to provide a plasma lighting system which may achieve a luminous flux of a given level or more and a predetermined color rendering index while maintaining a desired luminous efficacy.

To achieve these objects and other advantages and in accordance with the purpose of the invention, as embodied and broadly described herein, a plasma lighting system includes a magnetron configured to generate microwaves, a bulb filled with a main dose and an additive dose, wherein the main dose and the additive dose generate light under the influence of microwaves and have maximum intensities of respective intrinsic wavelengths at different wavelengths, a waveguide configured to guide the microwaves generated by the magnetron to the bulb, a motor configured to rotate the bulb, a sensor configured to sense the intensity of light having a specific wavelength emitted from the bulb, and a controller connected to the motor, wherein the controller adjusts the Revolutions Per Minute (RPM) of the bulb based on the intensity of light having the specific wavelength sensed by the sensor.

Here, when the microwaves are applied, the main dose may be converted into plasma at a first temperature and the additive dose may be converted into plasma at a second temperature higher than the first temperature.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE INVENTION

Hereinafter, a plasma lighting system according to one embodiment of the present invention will be described in detail with reference to the accompanying drawings. The accompanying drawings show an exemplary configuration of the present invention and are merely provided to describe the present invention in detail, and the scope of the present invention is not limited by the accompanying drawings and the detailed description thereof.

Figure 1:
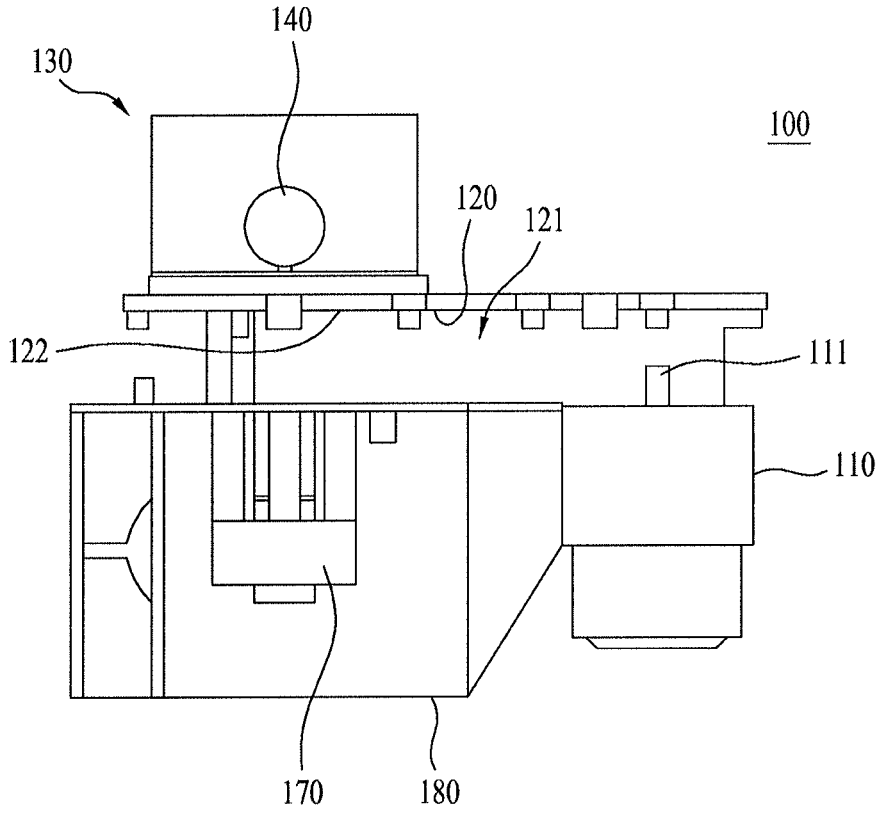
FIG. 1 is a conceptual view showing a plasma lighting system according to one embodiment of the present invention.
Figure 2:
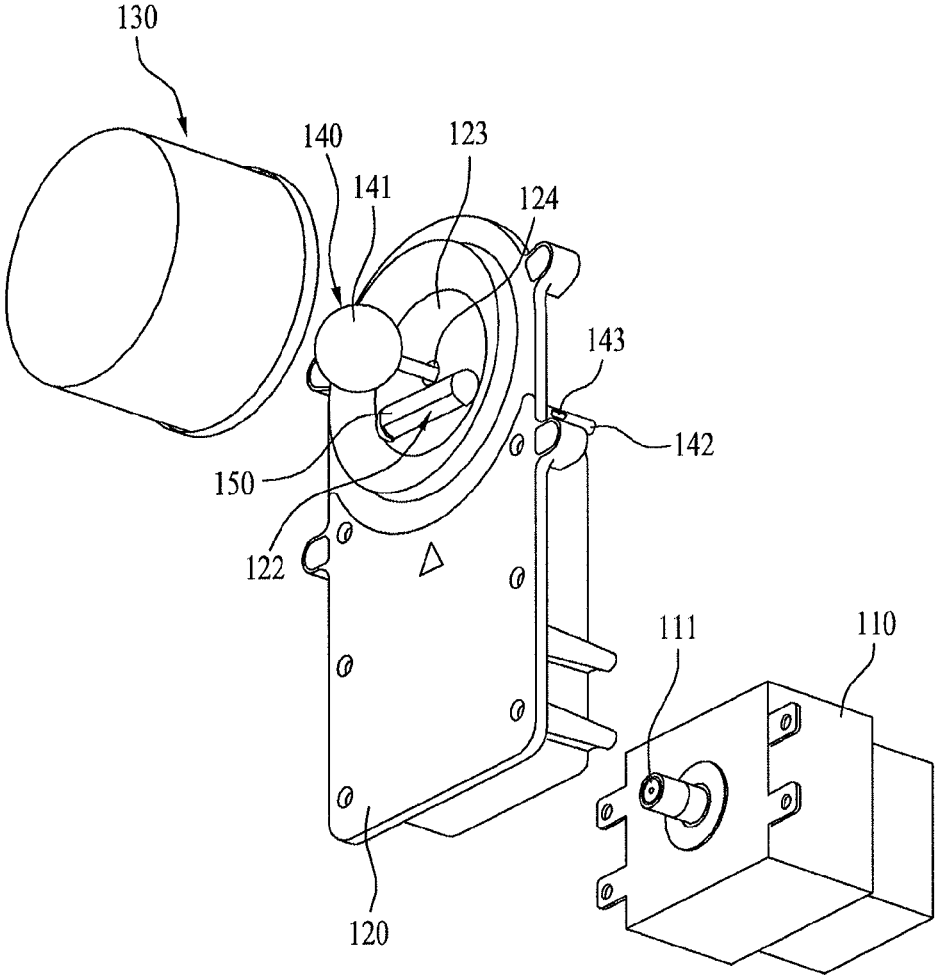
FIG. 2 is an exploded perspective view showing the plasma lighting system according to the embodiment of the present invention.

FIG. 1 is a conceptual view showing a plasma lighting system according to one embodiment of the present invention, and FIG. 2 is an exploded perspective view showing the plasma lighting system according to the embodiment of the present invention.

Referring to FIGS. 1 and 2, the plasma lighting system, designated by reference numeral 100, includes a magnetron 110, a waveguide 120, a bulb 140, and a motor 170. In addition, the plasma lighting system 100 may include a resonator 130 surrounding the bulb 140.

In addition, the plasma lighting system 100 may include a housing 180 defining an external appearance of the plasma lighting system 100. The motor 170 and/or the magnetron 110 may be received in the housing 180. In addition, at least a portion of the waveguide 120 may be received in the housing 180.

Hereinafter, the respective constituent elements of the plasma lighting system 100 will be described in detail.

The magnetron 110 serves to generate microwaves having a predetermined frequency. In addition, a high voltage generator may be formed integrally with or separately from the magnetron 110.

The high voltage generator generates a high voltage. As the high voltage generated by the high voltage generator is applied to the magnetron 110, the magnetron 110 generates microwaves having a radio frequency.

The waveguide 120 functions to guide the microwaves generated by the magnetron 110 to the bulb 140. More specifically, the waveguide 120 may include a waveguide space 121 for guidance of the microwaves generated by the magnetron 110, and an opening 122 for transmission of the microwaves to the resonator 130.

In addition, the interior of the waveguide 120 may function to guide the microwaves, and the outer circumferential surface of the waveguide 120 may define an external appearance of the plasma lighting system 100.

An antenna unit 111 of the magnetron 110 may be inserted into the waveguide space 121. The microwaves are guided through the waveguide space 121, and thereafter transmitted to the interior of the resonator 130 through the opening 122.

The resonator 130 creates a resonance mode by preventing outward discharge of the introduced microwaves. The resonator 130 may function to generate a strong electric field by exciting the microwaves. In one embodiment, the resonator 130 may have a mesh form.

In addition, to allow the microwaves to be introduced into the resonator 130 only through the opening 122, the resonator 130 may be mounted to surround the opening 122 of the waveguide 120 and the bulb 140.

A reflective member 150 may be mounted at the opening 122 of the waveguide 120 to surround a portion of the opening 122. More specifically, the reflective member 150 may be mounted at a predetermined region 123 of the waveguide 120 having the opening 122.

The bulb 140 may penetrate the predetermined region 123 to thereby be connected to the motor 170. The predetermined region 123 may be surrounded by the resonator 130. More specifically, a rotating shaft 142 of the bulb 140 penetrates the predetermined region 123. The predetermined region 123 has an insertion hole 124 for insertion of the rotating shaft 142 of the bulb 140.

Meanwhile, the reflective member 150 functions to guide the microwaves to be introduced into the resonator 130 through the opening 122.

In addition, the reflective member 150 may function to reflect the microwaves introduced into the resonator 130 toward the bulb 140, in order to concentrate an electric field on the bulb 140.

The bulb 140, in which a light emitting material is received, may be placed within the resonator 130, and the rotating shaft 142 of the bulb 140 may be coupled to the motor 170 as described above.

Rotating the bulb 140 via the motor 170 may prevent generation of a hot spot or concentration of an electric field on a specific region of the bulb 140.

The bulb 140 may include a spherical casing 141 in which a light emitting material is received, and the rotating shaft 142 extending from the casing 141.

In addition, a sensor 143 is mounted to the rotating shaft 142 of the bulb 140 to sense optical properties of light emitted from the bulb 140.

The sensor 143 may be installed to the rotating shaft 142 of the bulb 140 so as to be received in the housing 180. In addition, the sensor 143 may be located at a portion of the rotating shaft 142 of the bulb 140. That is, the sensor 143 may serve to sense optical properties of light emitted by the bulb 140 and reflected into the waveguide 120 through the insertion hole 124 for passage of the rotating shaft 142 of the bulb 140.

The sensor 143 may be a photo sensor. The photo sensor functions to measure (sense) the intensity of light having a specific wavelength emitted from the bulb 140. More specifically, the photo sensor 143 may serve to sense optical properties of light having passed through a clearance between the rotating shaft 142 of the bulb 140 and the insertion hole 124.

In addition, a plurality of photo sensors may be provided. Here, the photo sensors may be configured to measure intensities of light at different specific wavelengths respectively. The number of the photo sensors may be equal to the number of additive doses that will be described hereinafter.

The light emission principle of the plasma lighting system 100 having the above-described configuration will be described below.

Microwaves generated in the magnetron 110 are transmitted to the resonator 130 through the waveguide 120. Then, as the microwaves introduced into the resonator 130 are resonated in the resonator 130, the light emitting material in the bulb 140 is excited.

In this case, the light emitting material received in the bulb 140 generates light via conversion thereof into plasma, and the light is emitted outward of the resonator 130.

Meanwhile, the plasma lighting system 100 may further include a reflective member (not shown) to adjust the direction of light emitted from the bulb 140 and to guide the light outward of the resonator 130. The reflective member may be a semi-spherical shade.

In this specification, the term "dose" represents a light emitting material that emits light by being excited by microwaves. The bulb 140 is filled with the dose. Specifically, the dose consists of a main dose including sulfur, and an additive dose to control a Color Rendering Index (CRI) of the plasma lighting system 100. The additive dose may increase or reduce the CRI of the plasma lighting system 100.

Figure 3:
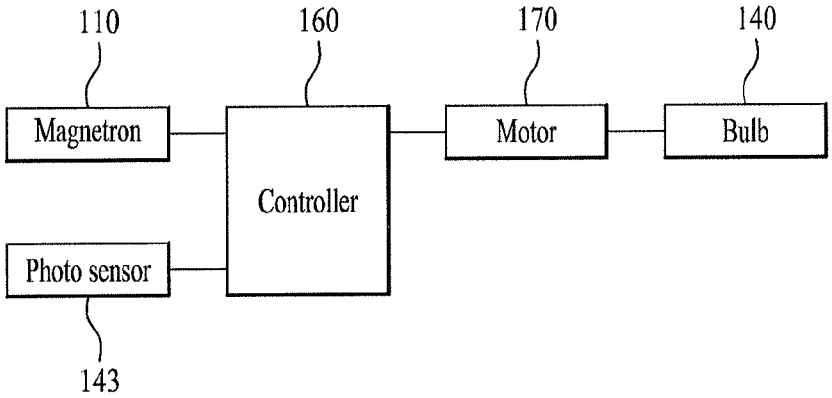
FIG. 3 is a view showing a configuration of the plasma lighting system according to the embodiment of the present invention.

FIG. 3 is a view showing a configuration of the plasma lighting system according to the embodiment of the present invention.

The plasma lighting system 100 includes a controller 160 connected to the motor 170 to adjust Revolutions Per Minute (RPM) of the motor 170. The controller 160 may adjust the RPM of the motor 170 by adjusting an input voltage supplied to the motor 170. The controller 160 is electrically connected to the photosensor 143 so as to receive information of optical properties from the photo sensor 143.

As described above, the rotating shaft 142 of the bulb 140 is mounted to the motor 170. The RPM of the bulb 140 may be adjusted by adjusting the RPM of the motor 170. The RPM of the bulb 140 is adjusted by the controller 160.

In summary, the controller 160 may adjust the RPM of the motor 170, thereby adjusting the RPM of the bulb 140 connected to the motor 170.

Meanwhile, the bulb 140 radiates heat outward via rotation thereof. Accordingly, the RPM of the bulb 140 is associated with the temperature of the bulb 140.

More specifically, when the RPM of the bulb 140 (or the RPM of the motor 170) is increased, the temperature of the bulb 140 is lowered. In addition, when the RPM of the bulb 140 (or the RPM of the motor 170) is reduced, the temperature of the bulb 140 is raised.

In one embodiment, the controller 160 may reduce an input voltage of the motor 170 in order to raise the temperature of the bulb 140. Conversely, the controller 160 may increase an input voltage of the motor 170 in order to lower the temperature of the bulb 140.

In addition, the temperature of the bulb 140 is associated with a temperature at which the dose is converted into plasma.

In one embodiment, the temperature of the bulb 140 is associated with the boiling point of the dose.

As described above, the dose within the bulb 140 generates light by being converted into plasma. More specifically, as the temperature of the bulb 140 is raised to the boiling point of the dose or more, the dose is converted into plasma, thereby generating light.

Figure 4:
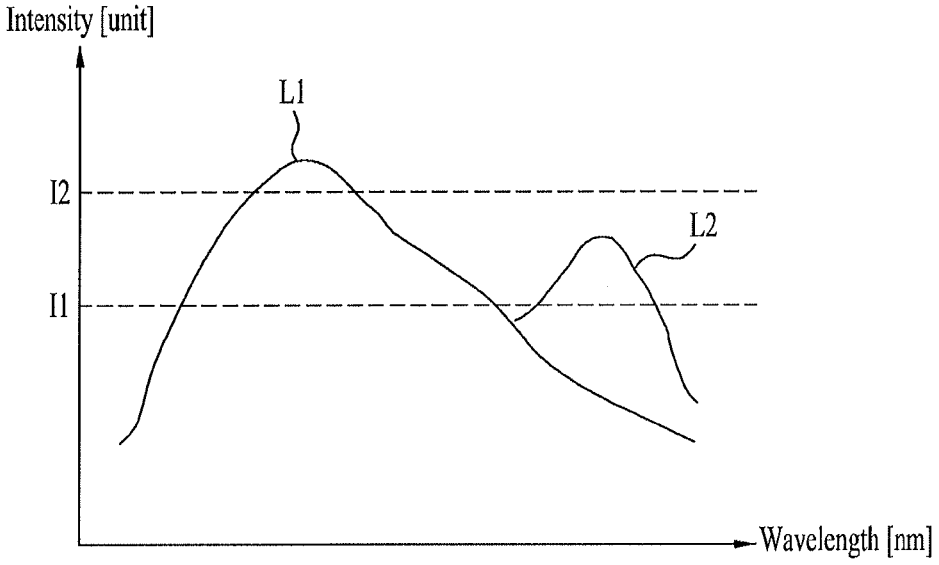
FIG. 4 is a graph showing an operational state of the plasma lighting system according to the present invention.

FIG. 4 is a graph showing an operational state of the plasma lighting system according to the present invention. Reference numeral L1 designates a radiation waveform of the main dose, and reference numeral L2 designates a radiation waveform of the additive dose.

The bulb 140 is filled with the main dose and the additive dose. The main dose and the additive dose respectively generate light at a predetermined temperature or more under the influence of microwaves.

Referring to FIG. 4, the main dose and the additive dose have maximum intensities of respective intrinsic wavelengths at different wavelengths.

The main dose functions to generate a flux of the plasma lighting system 100. The main dose may include sulfur. In this case, through the use of sulfur, the plasma lighting system 100 has optical properties of continuous spectra.

However, when only sulfur is used as the dose, the CRI of the plasma lighting system 100 may be about 80. In this case, the additive dose may function to increase the CRI of the plasma lighting system 100.

When microwaves are applied, the main dose may be converted into plasma at a first temperature and the additive dose may be converted into plasma at a second temperature that is higher than the first temperature.

More specifically, when microwaves are applied to the bulb 140 as described above, the temperature of the bulb 140 is gradually raised. In this case, when the temperature of the bulb 140 reaches the first temperature, the main dose is converted into plasma. Thereby, the plasma lighting system 100 emits light corresponding to an intrinsic wavelength of sulfur (the main dose). Thereafter, when the temperature of the bulb 140 reaches the second temperature that is higher than the first temperature, the additive dose is converted into plasma. In this case, the plasma lighting system 100 additionally emits light corresponding to an intrinsic wavelength of the additive dose.

The main dose and the additive dose in a plasma state are independent of each other in the bulb 140 except for special cases. Accordingly, the wavelength of light emitted from the plasma lighting system 100 may be the sum of the intrinsic wavelength L1 of the main dose and the intrinsic wavelength L2 of the additive dose (see FIG. 4).

In one embodiment, the boiling point of the main dose differs from the boiling point of the additive dose. More specifically, a temperature of the bulb 140 at which the main dose is evaporated to generate light differs from a temperature of the bulb 140 at which the additive dose is evaporated to generate light.

As described above, through adjustment of the temperature of the bulb 140, only the main dose may undergo plasma evaporation to generate light, or both the main dose and the additive dose may undergo plasma evaporation to generate light.

As described above, the main dose and the additive dose have maximum intensities of respective intrinsic wavelengths at different wavelengths. Accordingly, a first case in which light is generated as only the main dose is converted into plasma and a second case in which light is generated as both the main dose and the additive dose are converted into plasma result in different optical properties (for example, CRI).

Here, the boiling point of the additive dose is higher than the boiling point of the main dose. In addition, the additive dose may have a higher melting point and higher boiling point than those of the main dose.

The controller 160 adjusts the RPM of the bulb 140 based on the intensity of light having a specific wavelength sensed by the sensor 143. CRI is associated with emission of light in several wavelength bands. The additive dose functions to increase the CRI of the plasma lighting system 100.

In one embodiment, a general plasma lighting system may include sulfur as a main dose and emit slightly bluish light because of a relatively insufficient wavelength of red.

Accordingly, in order to increase the CRI of the plasma lighting system 100, it is necessary to increase the intensity of light having a long wavelength (red type). Increase in the intensity of light having a long wavelength of red type may be realized by the additive dose.

In this case, the sensor 143 may sense the intensity of a peak wavelength of the additive dose required to provide light emitted from the bulb 140 with a predetermined CRI or more.

In addition, when the intensity of the peak wavelength of the additive dose is the minimum intensity or more, light emitted from the bulb 140 may maintain a predetermined CRI or more.

Referring to FIG. 4, the controller 160 may adjust the RPM of the bulb 140 such that the intensity of light having a specific wavelength measured by the sensor 143 is maintained between a first intensity I1 and a second intensity I2 greater than the first intensity I1.

More specifically, the first intensity I1 may be the minimum intensity of the peak wavelength of the additive dose required to provide light emitted from the bulb 140 with a predetermined CRI or more. That is, the controller 160 may adjust the RPM of the bulb 140 such that the intensity of the peak wavelength of the additive dose sensed by the sensor 143 is maintained at the minimum intensity (the first intensity I1) or more.

For example, the intensity of the peak wavelength of the additive dose sensed by the sensor 143 may be less than the minimum intensity. In this case, the controller 160 may raise the temperature of the bulb 140 for conversion of the additive dose into plasma.

In such a case, the controller 160 may reduce the RPM of the bulb 140. That is, the controller 160 may reduce an input voltage of the motor 170 such that the RPM of the motor 170 is reduced.

Meanwhile, when energy such as microwaves is applied to the bulb 140, the energy may be distributed to the main dose (sulfur) and the additive dose, and may be consumed by the main dose and the additive dose.

In this case, the additive dose emits visible light about a specific wavelength. Accordingly, a flux of the plasma lighting system 100 is mainly generated by the main dose, and the additive dose functions to increase the CRI of the plasma lighting system 100.

In a case in which the sensed intensity of the peak wavelength of the additive dose is greater than the second intensity I2, this means that a greater quantity of energy is distributed to the additive dose. That is, the quantity of energy distributed to the main dose is reduced. In this case, the efficiency of the plasma lighting system 100 is lowered.

Accordingly, the intensity of light having a specific wavelength measured by the sensor 143 may be maintained between the first intensity I1 and the second intensity I2 greater than the first intensity I1.

The additive dose may include at least one of calcium bromide ($CaBr_2$) and calcium iodide ($CaI_2$). In addition, the additive dose may include at least one of a first additive dose having the maximum intensity of an intrinsic wavelength at a lower wavelength than that of sulfur, and a second additive dose having the maximum intensity of an intrinsic wavelength at a higher wavelength than that of sulfur.

In this case, the first additive dose may include at least one metal halide.

More specifically, the first additive dose may include a compound of a metal and a halogen.

The metal may be one selected from the group consisting of potassium (K), copper (Cu), barium (Ba), and cesium (Cs). In addition, the halogen may be one selected from the group consisting of chlorine (Cl), bromine (Br), iodine (I), and astatine (At).

More specifically, the first additive dose may be at least one of compounds of a metal including K, Cu, Ba, or Cs and a halogen including Cl, Br, I, or At.

In addition, the second additive dose may include a compound of a metal and a halogen.

The metal of the second additive dose may be one selected from the group consisting of lithium (Li), sodium (Na), calcium (Ca), strontium (Sr), and rubidium (Rb). In addition, the halogen of the second additive dose may be one selected from the group consisting of chlorine (Cl), bromine (Br), iodine (I), and astatine (At).

More specifically, the second additive dose may be at least one of compounds of a metal including Li, Na, Ca, Sr, or Rb and a halogen including Cl, Br, I, or At.

Figure 5:
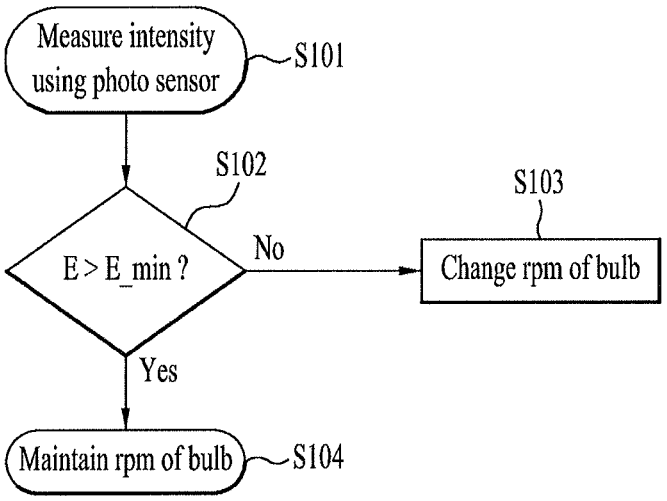
FIGS. 5 and 6 are flowcharts showing a control method of the plasma lighting system according to the present invention.
Figure 6:
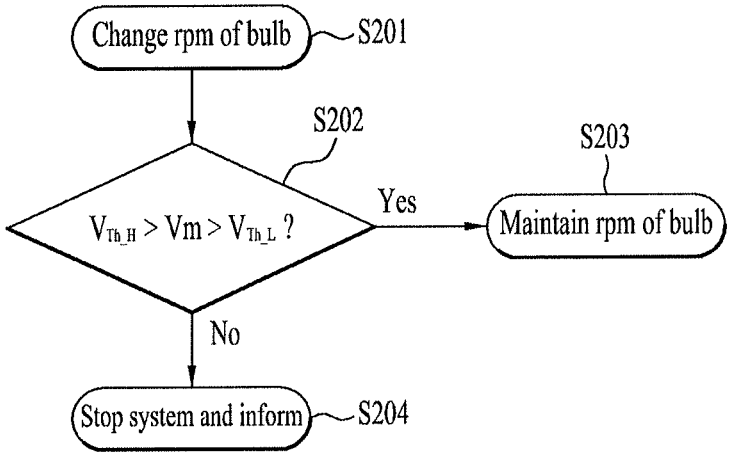

FIGS. 5 and 6 are flowcharts showing a control method of the plasma lighting system according to the present invention.

Referring to FIG. 5, the control method of the plasma lighting system 100 is a CRI control method of the plasma lighting system 100.

The control method includes measuring the intensity of light having a specific wavelength using the photo sensor 143 (S101). The measuring step S101 using the photo sensor 143 may be implemented in a state in which plasma in the bulb 140 is in a quasi-stable state after power is applied to the plasma lighting system 100.

The photo sensor 143 may be a photo sensor sensitive to a wavelength (i.e. peak wavelength) having the maximum intensity of an intrinsic wavelength generated by the additive dose that is added to sulfur (the main dose). In addition, when a plurality of additive doses is added, a plurality of photo sensors may be provided.

In addition, the control method includes comparing a measured value E of the photo sensor 143 with the minimum intensity E_min of the peak wavelength of the additive dose required to provide light emitted from the bulb 140 with a predetermined CRI or more (S102).

In this case, when the measured value E of the photo sensor 143 is greater than the minimum intensity E_min of the peak wavelength of the additive dose, the controller 160 may maintain the RPM of the bulb 140 (S104). Conversely, when the measured value E of the photo sensor 143 is less than the minimum intensity E_min of the peak wavelength of the additive dose, the controller 160 may change the RPM of the bulb 140 (S103).

Meanwhile, the controller 160 may repeatedly implement the measuring step S101 and the comparing step S102 at a predetermined time interval. In addition, the controller 160 may reduce an input voltage of the motor 170 in order to increase the temperature of plasma in the bulb 140 based on properties of the additive dose. Conversely, the controller 160 may increase an input voltage of the motor 170 in order to reduce the temperature of plasma in the bulb 140.

Referring to FIG. 6, the control method of the plasma lighting system 100 may further include the following operations.

As described above, the operation of comparing the measured value E of the photo sensor 143 with the minimum intensity E_min of the peak wavelength of the additive dose required to provide light emitted from the bulb 140 with a predetermined CRI or more is implemented. In this case, when the measured value E is less than the minimum intensity E_min, the RPM of the bulb 140 is changed (S201).

Changing the RPM of the bulb 140 may be implemented via a change in the input voltage of the motor 170. In this case, the controller 160 judges whether or not the input voltage Vm of the motor 170 falls within a predetermined range (S202). That is, the changed input voltage Vm of the motor 170 must be equal to or less than the maximum input voltage $V_{Th_H}$ to enable driving of the motor 170. Likewise, the changed input voltage Vm of the motor 170 must be the minimum input voltage $V_{Th_L}$ of the motor 170 or more.

Here, the minimum input voltage $V_{Th_L}$ of the motor 170 corresponds to a voltage that does not cause flickering of the plasma lighting system 100 and provides the bulb 140 with a predetermined RPM to prevent the surface temperature of the bulb 140 from exceeding a given temperature.

In this case, when the input voltage of the motor 170 deviates from a given range, the controller 160 may stop the system 100 and output an alarm signal to the user (S204).

More specifically, the controller 160 may power off the plasma lighting system 100. Simultaneously or sequentially, the controller 160 may inform the user of power-off via communication, LED flickering, or the like.

In addition, when the input voltage of the motor 170 falls within the given range, the controller 160 maintains the changed RPM of the bulb 140 (S203). Thereafter, when a predetermined time (e.g., 60 seconds) has passed, the controller 160 may again implement comparison between the measured value E of the photo sensor 143 and the minimum intensity E_min of the peak wavelength of the additive dose required to provide light emitted from the bulb 140 with a predetermined CRI or more.

As is apparent from the above description, a plasma lighting system according to one embodiment of the present invention has the following effects.

As a bulb filled with at least one additive dose such as a metal halide and the additive dose is converted into plasma, a Color Rendering Index (CRI) of the plasma lighting system may be controlled. In particular, control of CRI may be implemented during operation of the plasma lighting system.

In addition, as the temperature of the bulb is adjusted to selectively evaporate the additive dose, the intensity of light having a specific wavelength may be increased or reduced. In this case, the temperature of the bulb may be adjusted by controlling the RPM of the bulb.

In addition, the boiling point of the additive dose is higher than the boiling point of the main dose. Thus, the main dose, such as sulfur, may first be evaporated, and thereafter the additive dose may be selectively evaporated. In this way, the plasma lighting system may achieve a luminous flux of a given level or more and a predetermined CRI while maintaining a desired luminous efficacy.

It will be apparent to those skilled in the art that various modifications and variations can be made in the present invention without departing from the spirit or scope of the invention. Thus, it is intended that the present invention covers the modifications and variations of this invention provided they come within the scope of the appended claims and their equivalents.

What is claimed is:

1. A plasma lighting system comprising:

a magnetron configured to generate microwaves;

a bulb filled with a main dose and an additive dose, wherein the main dose and the additive dose generate light under the influence of microwaves and have maximum intensities of respective intrinsic wavelengths at different wavelengths;

a motor configured to rotate the bulb;

a sensor configured to sense an intensity of light having a specific wavelength emitted from the bulb; and a controller connected to the motor, wherein the controller is configured to adjust Revolutions Per Minute (RPM) of the bulb based on the intensity of light having the specific wavelength sensed by the sensor.

2. The system according to claim 1, wherein, when the microwaves are applied, the main dose is converted into plasma at a first temperature and the additive dose is converted into plasma at a second temperature higher than the first temperature.

3. The system according to claim 2, wherein the controller is configured to reduce the RPM of the bulb to convert the additive dose into plasma after the main dose is converted into plasma.

4. The system according to claim 1, wherein the controller is configured to adjust the RPM of the bulb such that the intensity of light having the specific wavelength measured by the sensor is maintained between a first intensity and a second intensity greater than the first intensity.

5. The system according to claim 4, wherein the controller is configured to adjust an input voltage of the motor in order to adjust the RPM of the bulb.

6. The system according to claim 4, wherein the first intensity is a minimum intensity of a peak wavelength of the additive dose required to provide light emitted from the bulb with a predetermined Color Rendering Index (CRI) or more.

7. The system according to claim 1, wherein the main dose includes sulfur, and wherein the additive dose includes at least one of calcium bromide ($CaBr_2$) and calcium iodide ($CaI_2$).

8. The system according to claim 1, wherein the sensor is installed to a rotating shaft of the bulb.

9. The system according to claim 1, wherein the bulb includes a casing in which the main dose and the additive dose are filled, and a rotating shaft extending from the casing, and wherein the sensor is installed to the rotating shaft.

10. The system according to claim 1, wherein the additive dose includes a first additive dose having a maximum intensity of an intrinsic wavelength at a lower wavelength than that of the main dose, and a second additive dose having a maximum intensity of an intrinsic wavelength at a higher wavelength than that of the main dose.

11. A plasma lighting system comprising:

a magnetron configured to generate microwaves;

a bulb filled with a main dose and one or more additive doses, wherein the main dose and the additive doses generate light under the influence of microwaves and have maximum intensities of respective intrinsic wavelengths at different wavelengths;

a waveguide configured to guide the microwaves generated by the magnetron to the bulb;

a motor configured to rotate the bulb;

one or more sensors each configured to sense an intensity of light having a specific wavelength emitted from the bulb; and a controller connected to the motor, wherein the controller in configured to adjust Revolutions Per Minute (RPM) of the bulb based on the intensity of light having the specific wavelength sensed by each sensor, and wherein the main dose and the additive doses have different boiling points.

12. The system according to claim 11, wherein the bulb includes a casing in which the main dose and the additive doses are filled, and a rotating shaft extending from the casing, and wherein the sensors are installed to the rotating shaft.

13. The system according to claim 11, wherein the number of the sensors is equal to the number of the additive doses.

14. The system according to claim 11, wherein, when the microwaves are applied, the main dose is converted into plasma at a first temperature and the additive doses are converted into plasma at temperatures higher than the first temperature.

15. The system according to claim 14, wherein the controller is configured to reduce the RPM of the bulb to convert the additive doses into plasma after the main dose is converted into plasma.

16. The system according to claim 11, wherein the controller is configured to adjust the RPM of the bulb such that the intensity of light having the specific wavelength measured by each sensor is maintained between a first intensity and a second intensity greater than the first intensity.

17. A plasma lighting system comprising:

a magnetron configured to generate microwaves;

a bulb filled with a main dose and one or more additive doses, wherein the main dose and the additive doses generate light under the influence of microwaves and have maximum intensities of respective intrinsic wavelengths at different wavelengths;

a waveguide configured to guide the microwaves generated by the magnetron to the bulb;

a motor configured to rotate the bulb;

one or more photo sensors configured to sense an intensity of light generated from the additive doses; and a controller connected to the motor, wherein the controller is configured to adjust Revolutions Per Minute (RPM) of the bulb based on the intensity of light sensed by each photo sensor.

18. The system according to claim 17, wherein the main dose and the additive doses have different boiling points.

19. The system according to claim 17, wherein the controller is configured to adjust the RPM of the bulb such that the intensity of light measured by each photo sensor is maintained between a first intensity and a second intensity greater than the first intensity.

20. The system according to claim 17, wherein the first intensity is a minimum intensity of a peak wavelength of the additive doses required to provide light emitted from the bulb with a predetermined Color Rendering Index (CRI) or more.

* * * * *